US007247037B2

(12) United States Patent
Smadi et al.

(10) Patent No.: US 7,247,037 B2
(45) Date of Patent: Jul. 24, 2007

(54) METHODS AND ARRANGEMENTS FOR AN ADAPTER TO IMPROVE ELECTROSTATIC DISCHARGE PROTECTION

(75) Inventors: Mithkal M. Smadi, Round Rock, TX (US); Anthony C. Spielberg, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/295,301

(22) Filed: Dec. 6, 2005

(65) Prior Publication Data

US 2007/0128908 A1 Jun. 7, 2007

(51) Int. Cl.
*H01R 13/53* (2006.01)

(52) U.S. Cl. ..... 439/181; 439/88

(58) Field of Classification Search ..... 439/181, 439/88, 188, 95, 98
See application file for complete search history.

(56) References Cited

U.S. PATENT DOCUMENTS

| | | | | |
|---|---|---|---|---|
| 4,152,041 | A * | 5/1979 | Hollyday et al. | 439/188 |
| 4,179,178 | A | 12/1979 | Bachman et al. | |
| 4,568,133 | A * | 2/1986 | Amano et al. | 439/108 |
| 4,780,604 | A | 10/1988 | Hasegawa et al. | |
| 4,849,944 | A | 7/1989 | Matsushita | |
| 4,952,758 | A | 8/1990 | Dara et al. | |
| 5,088,931 | A | 2/1992 | Niciolo et al. | |
| 5,164,880 | A | 11/1992 | Cronin | |
| 5,244,397 | A | 9/1993 | Anhalt | |
| 5,259,777 | A | 11/1993 | Schuder et al. | |
| 5,490,033 | A * | 2/1996 | Cronin | 361/212 |
| 5,812,357 | A | 9/1998 | Johansen et al. | |

(Continued)

FOREIGN PATENT DOCUMENTS

| | | | |
|---|---|---|---|
| DE | 4111049 | A1 | 10/1991 |
| EP | 0233649 | B1 | 8/1987 |
| EP | 0260808 | B1 | 3/1988 |
| EP | 0501749 | B1 | 9/1992 |
| EP | 0661912 | B1 | 7/1995 |
| WO | WO 98/16954 | A1 | 4/1998 |
| WO | WO 02/073741 | A2 | 9/2002 |

OTHER PUBLICATIONS

U.S. Appl. No. 60/275,045, filed Mar. 12, 2001, Bohbot, M.
ISR including PCT transmittal & Written Opinion, From the International Searching Authority, mailed Feb. 9, 2007, Applicant: International Business Machines Corporation, International Application No. PCT/EP2006/067943, pp. -12.

*Primary Examiner*—Hae Moon Hyeon
(74) *Attorney, Agent, or Firm*—Gregory M. Doudnikoff; Schubert Osterrieder & Nickelson PLLC

(57) ABSTRACT

Methods and arrangements to adapt an electronic system to attenuate electrostatic discharges of a cable as the cable is connected with a connector on the electronic system are disclosed. Embodiments may include an adapter to couple with a connector of an electronic system. The adapter may momentarily interconnect conductors of a cable with a selected conductor of the connecter to discharge to attenuate or discharge an electrostatic charge built up on the conductors of the cable. In some embodiments, the adapter includes a selector switch so the selected conductor can be selected based upon the electronic system. In other embodiments, the selected conductor is fixed.

20 Claims, 6 Drawing Sheets

U.S. PATENT DOCUMENTS 5,882,217 A * 3/1999 Aponte et al. ..... 439/188
5,947,773 A 9/1999 Karam
6,151,202 A 11/2000 Mueller et al.
6,390,839 B2 * 5/2002 Miwa ..... 439/181
6,648,661 B1 11/2003 Byrne et al.
6,663,402 B1 * 12/2003 Yu ..... 439/108
6,780,035 B2 * 8/2004 Bohbot ..... 439/188
6,790,097 B1 * 9/2004 Edwards et al. ..... 439/676
6,875,060 B2 * 4/2005 Musolf et al. ..... 439/668
6,955,551 B2 * 10/2005 Yamamoto ..... 439/181

* cited by examiner

METHODS AND ARRANGEMENTS FOR AN ADAPTER TO IMPROVE ELECTROSTATIC DISCHARGE PROTECTION

CROSS-REFERENCE TO RELATED APPLICATION

This application is related to U.S. patent application Ser. No. 11/295,302, entitled "METHODS AND ARRANGEMENTS TO ATTENUATE CABLE DISCHARGE", filed on the same day, the disclosure of which is incorporated herein in its entirety for all purposes.

FIELD OF INVENTION

The present invention is in the field of cable connections for electronic systems. More particularly, the present invention relates to methods and arrangements to adapt an electronic system to attenuate electrostatic discharges of a cable as the cable is connected with a connector on the electronic system.

BACKGROUND

Any time a cable is connected to a computer system (e.g., through USB, FireWire, or other common input/output ports) there is a risk of damage to the system resulting from a Cable Discharge Event (CDE.) A CDE results from static charge having accumulated on the cable and being discharged to the computer system when the cable is connected to the computer system. For example, in many office settings, personnel may be moved from one location to another to re-task the personnel, move locations, or the like. Computers for the personnel may be moved along with the personnel and reconnected to a network at the new location. Moving cable with a isolated pins and shielding can often build up an electrostatic charge as the cables rub against one another, rub against the carpet or wall, or even as materials within the cable rub against one another.

Electrostatic charges that build up on the cables can vary significantly in voltage depending upon the relative humidity and the materials involved. For instance, just walking across a carpeted area when the relative humidity is about 65% to 90% can typically generate an electrostatic charge of 1,500 volts. Walking across the same carpeted area when the relative humidity is approximately 10% to 20% humidity can generate an electrostatic charge of 35,000 volts.

ESD is a serious issue in electronic systems. When a statically-charged cable is connected to an electrostatic discharge sensitive (ESDS) electronic system, there is a possibility that the electrostatic charge may discharge through sensitive circuitry in the electronic system. High voltages can damage or degrade insulating materials and, if the electrostatic discharge possesses sufficient energy, damage could occur due to localized overheating. In general, devices with finer geometries are more susceptible to damage from ESD.

Integrated circuits (ICs) are particularly susceptible to ESD, especially when considering the drive to build ICs with smaller geometries in successive generations. ICs are made from semiconductor materials such as silicon and insulating materials such as silicon dioxide, which can break down if exposed to high voltages. Manufacturers and users of ICs must take precautions to avoid this problem. Such measures include appropriate packing material, the use of conducting wrist straps and foot-straps to prevent high voltages from accumulating on workers' bodies, anti-static mats to conduct harmful electric charges away from the work area, and humidity control.

Designers of computer systems typically attempt to protect their products from CDE damage by incorporating electrostatic discharge (ESD) protection structures into the components used in their systems; in the event of a CDE, these ESD protection structures are designed to route the charge from the cable to ground and thus avoid or attenuate damage to the protected components.

In practice, however, the use of ESD protection devices on components offers only limited protection. Individual ESD structures vary in their ability to handle ESD events, and can wear out over time from handling ESD events. Severe CDEs can easily exceed the capabilities of even the best ESD protection structures and cause immediate and catastrophic damage to computer systems. For example, many ESD protection devices can handle up to approximately 2,000 volts but are damaged in the event of a higher voltage ESD.

Once a computer system has been manufactured and sold, there is no feasible option for changing its internal design or structure to improve its resistance to CDEs.

SUMMARY OF THE INVENTION

The problems identified above are in large part addressed by methods and arrangements to adapt an electronic system to attenuate electrostatic discharges of a cable as the cable is connected with a connector on the electronic system. One embodiment provides an apparatus. The apparatus may comprise a connection adapter to couple with a connector, the connection adapter comprising conductor connections to interconnect conductors of a cable with conductors of the connector. An isolator may couple the conductors of the cable with a selected conductor of the connector in a first state and to couple the conductors of the cable with corresponding conductors of the connector in a second state. The apparatus may further comprise a discharge device coupled with the isolator to switch the isolator from the first state to the second state while coupling the cable with the connector.

Another embodiment provides an electronic system with an adapter to attenuate electrostatic discharges of a cable as the cable is connected with a connector on the electronic system. The system may comprise an enclosure comprising a connector, wherein the connector is adapted to facilitate communication with circuitry in the enclosure. The system may also comprise a connection adapter to couple with the connector, the connection adapter comprising conductor connections to interconnect conductors of a cable with conductors of the connector; and an isolator to couple the conductors of the cable with a selected conductor of the connector in a first state and to couple the conductors of the cable with corresponding conductors of the connector in a second state. A discharge device coupled with the isolator may switch the isolator from the first state to the second state while coupling the cable with the electronic system.

A further embodiment provides a method to attenuate electrostatic discharges of a cable as the cable is connected with a connector on the electronic system. The method may involve interconnecting conductors of a cable with a selected conductor of a connector to discharge an electrostatic charge from the conductors through the selected conductor; disconnecting the conductors from the selected conductor; and interconnecting the conductors with corresponding conductors of the connector.

BRIEF DESCRIPTION OF THE DRAWINGS

Advantages of the invention will become apparent upon reading the following detailed description and upon reference to the accompanying drawings in which, like references may indicate similar elements.

DETAILED DESCRIPTION OF EMBODIMENTS

The following is a detailed description of embodiments of the invention depicted in the accompanying drawings. The embodiments are in such detail as to clearly communicate the invention. However, the amount of detail offered is not intended to limit the anticipated variations of embodiments, but on the contrary, the intention is to cover all modifications, equivalents, and alternatives falling within the spirit and scope of the present invention as defined by the appended claims. The detailed descriptions below are designed to make such embodiments obvious to a person of ordinary skill in the art.

Generally speaking, methods and arrangements to adapt an electronic system to attenuate electrostatic discharges of a cable as the cable is connected with a connector on the electronic system are contemplated. Embodiments may include an adapter to couple with a connector of an electronic system. The adapter may momentarily interconnect conductors of a cable with a selected conductor of the connector to discharge to attenuate or discharge an electrostatic charge built up on the conductors of the cable. In some embodiments, the adapter includes a selector switch so the selected conductor can be selected based upon the electronic system. In other embodiments, the selected conductor is fixed.

Adapters may comprise male-to-female connections, male-to male connections, female-to-male connections, female-to-female connections, and/or other types of connections. Some embodiments are designed to couple with proprietary connectors such as universal serial bus (USB) connectors, FireWire connectors, and the like.

Many embodiments comprise adapters designed to attach to a computer system to improve the computer system's ability to handle large electrostatic discharges from cables such as Ethernet cables, modem cables, high-speed serial cables, parallel cables, and/or other electrical communications cables.

Such embodiments may advantageously attenuate or even eliminate risk of cable discharge events (CDEs) and may be implemented at a relatively low cost. Furthermore, such embodiments may not rely on electrostatic discharge (ESD) protection on downstream components and may be transparent to the end user, requiring neither knowledge nor action by the end user. Embodiments may also be robust, substantially immune from avoidance or error, and highly reliable with minimal wear out.

While specific embodiments will be described below with reference to particular switch, circuit or logic configurations, those of skill in the art will realize that embodiments of the present invention may advantageously be implemented with other substantially equivalent configurations.

Figure 1:
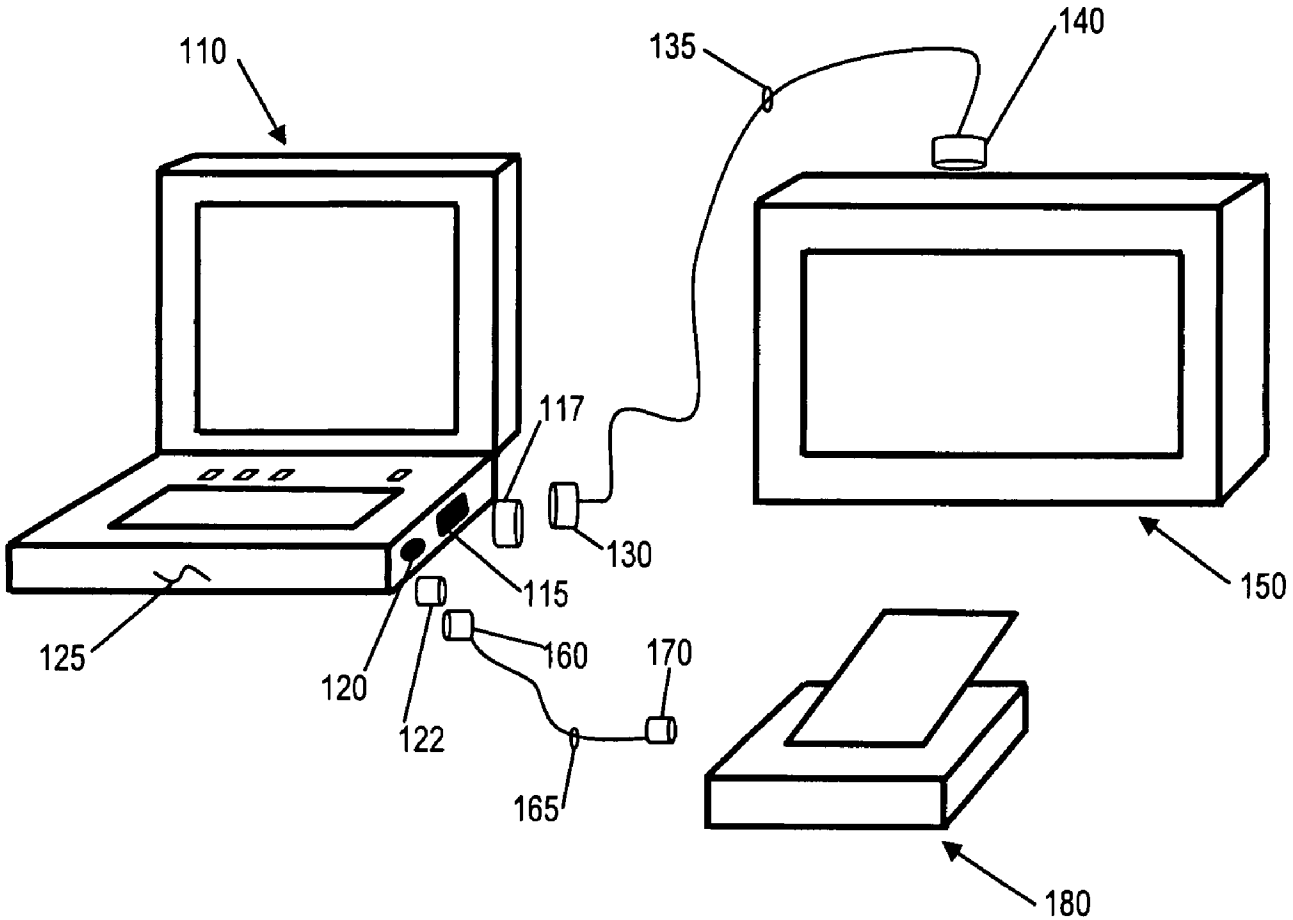
FIG. 1 depicts an embodiment of system comprising a computer, external display and a printer.

Turning now to the drawings, FIG. 1 depicts an embodiment of system 100 including a computer 110, an external display 150, and a printer 180. Cables 135 and 165 are adapted to interconnect external display 150 and printer 180, respectively, with computer 110. Cables 135 and 165 couple with computer 110 via adapters 117 and 122, respectively. For instance, an employee assigned use of system 100 may move to a new location to begin a new task or project. The employee may pack up system 100 without using recommended anti-static devices and bags to prevent the build up of an electrostatic charge on the cables 135 and 165, and then reassemble system 100 at the new location. As the employee connects the parallel cable 135 with connector 115 via adapter 117 on computer 110, adapter 117 may momentarily couple the conductors of cable 135 with a selected conductor of connector 115 to discharge the electrostatic charge from cable 135. Once the conductors of cable 135 are discharged, adapter 117 may automatically or manually couple the conductors of cable 135 with corresponding conductors of connector 115 to facilitate communications between external display 150 and computer 110.

Computer 110 comprises an electronic system with internal circuitry that may be sensitive to electrostatic discharges from cables such as cables 135 and 165. In the present embodiment, computer 110 is depicted as a laptop but computer 110 may be a desktop, workstation, server, personal digital assistant (PDA), stereo system, digital music player, cellular phone, or any other electronic system that comprises circuitry that may be sensitive to an electrostatic discharge and includes a connector such as connectors 115 and 120 to facilitate interconnection with an external device via, e.g., a cable.

Computer 110 comprises enclosure 125, a parallel connector 115, and a serial connector 120. Enclosure 125 may comprise an electrically conductive grounding structure integrated into the enclosure, mounted interior to the enclosure, or the like. The grounding structure may act as a ground for the discharging an electrostatic charge from cables 135 and 165 without damaging circuitry. In some embodiments, adapter 122 and/or adapter 117 may take advantage of a conductive enclosure 125 or interconnection between a connector such as 120 and a grounding structure of enclosure 125 by offering selection of the conductive enclosure 125 and/or a grounding structure via the adapter. For example, adapter 122 may include a selector that can switch between one or more conductors of connector 120, an electrically conductive connection between connector 120 and ground, an electrically conductive connection between connector 120 and a grounding structure, and/or other electrically conductive connections between adapter 120 and a ground.

Parallel connector 115 may be any type of electrical parallel connection and may couple with adapter 117 to discharge an electrostatic charge from conductors of cable 135 to a selected conductor. In some embodiments, adapter 117 may couple with connector 115 in a permanent or substantially permanent manner. For example, adapter 117 may include screws to fasten adapter 117 to connector 115. In other embodiments, the connection between adapter 117 and connector 115 may be more temporary. For instance, a frictional force between a housing of adapter 117 and a housing of connector 115 may tightly couple adapter 117 with computer 110.

Adapter 117 may comprise one or more brushes, filaments, or the like. The brushes, filaments, and/or the like may provide a path to discharge the electrostatic charge on cable 135. The path is more conductive that the air at the connector or has sufficient conductivity to attenuate or eliminate sparking through the air to the connector 115. For example, parallel connector 115 may include brushes positioned in an insertion path for connector 130 to contact the conductors of cable 135 as connector 130 is inserted into adapter 117. The brushes may remain in contact with the conductors of cable 135 sufficiently long to substantially discharge the electrostatic charge from cable 135 to a selected conductor of connector 115. Then, the brushes may disconnect from the conductors of cable 135 to facilitate connection between the conductors of cable 135 and conductors of connector 115. In other embodiments, a make-before-break connection may be implemented.

In still further embodiments, adapter 117 may connect one or more of the conductors of cable 135 with the selected conductor in more than one stages. For example, adapter 117 may couple three of the conductors of cable 135 to the selected conductor when cable connector 130 initially contacts adapter 117. Then adapter 117 may couple the next three conductors with the selected conductor to reduce the magnitude of the discharges.

In some embodiments, coupling the conductors of cable 135 with the selected conductor of connector 115 occurs automatically in response to force applied to cable 135 during the interconnection of connector 130 with adapter 117. For example, cable connector 130 may press a button or actuator on adapter 117 as cable connector 130 couples with adapter 117. The button or actuator may disconnect the conductors of cable 135 from the selected conductor and connect the conductors of cable 135 with the corresponding conductors of connector 115. In further embodiments, adapter 117 may be designed to attach to cable connector 130 prior to connecting adapter 117 with connector 115 of computer 110.

The selected conductor, in several embodiments, is hardwired in adapters such as adapter 117 and adapter 122 at manufacture. In other embodiments, adapters may comprise a selector to facilitate selection of the selected conductor after manufacture. For instance, in some adapters, a selector switch is built interior to the adapter so the adapter must be opened to effect a change to the selected conductor. Such impediments to changing the selected conductor help avoid accidental changes. Other adapters include a selector exterior to the adapter. For instance, a rotatary switch or sliding switch may be used to select a conductor for discharging the electrostatic charge from the cable. In some of these embodiments, a plate, screw, and/or the like may be utilized prevent accidental changes to the selected conductor.

Facilitating selection of a conductor can offer the user the opportunity to adapt the adapter for use with a number of different electronic systems. For instance, in one electronic system, conductor numbered two may be a circuit ground that is substantially insensitive to electrostatic discharges from cables. In another electronic system, the conductor numbered one may handle higher magnitude electrostatic discharges than other conductors.

Serial connector 120 may be any type electrical serial connection such as a round or rectangular 5-pin, 7-pin, or 12-pin serial connectors. For instance, serial connector 120 may comprise a proprietary serial connector such as a universal serial bus (USB) connector and/or a FireWire connector. Serial connector 120 couples with adapter 122 to discharge conductors of cable 165 as connector 160 couples with adapter 122.

In many embodiments, fully coupling cable connector 160 with adapter 122 switches the state of an isolator element from a first state, which is a discharge state, to a second state, which is a communications state. In several embodiments, switching the isolator element of adapter 122 from a discharge state to a communications state requires purposeful action by the user. For instance, cable connector 160 may initially fasten to adapter 122 when adapter 122 is in the discharge state, which interconnects the conductors of cable 165 with the selected conductor of connector 120. The user may then twist cable connector 160 a quarter of a rotation or 90 degrees to switch from the discharge state to the communications state, which interconnects the conductors of cable 165 to the corresponding conductors of connector 120 for communications between computer 110 and printer 180. In further embodiments, the user may press a button to switch from the discharge state to the communications state.

In some embodiments, display 150 may comprise an adapter coupled with a parallel connector such as parallel connector 115 to discharge cable 135 if connector 140 is plugged into external display 150 prior to plugging connector 130 into computer 110 via adapter 117. Similarly, printer 180 may comprise an adapter coupled with a serial connector such as serial connector 120 to discharge any electrostatic charge on cable 165 as connector 170 is inserted into the adapter on printer 180.

In further embodiments, one or more adapters may couple with cable 135 and/or 165 and may comprise brushes, filaments, or the like to couple conductors of cable 135 or 165 together at least momentarily prior to connection with an electronic device. Coupling the conductors together can redistribute electrostatic charge among conductors of cable 135 or 165. The electrostatic charge may then be discharged via a selected conductor of connector 115 or 120.

Figure 2:
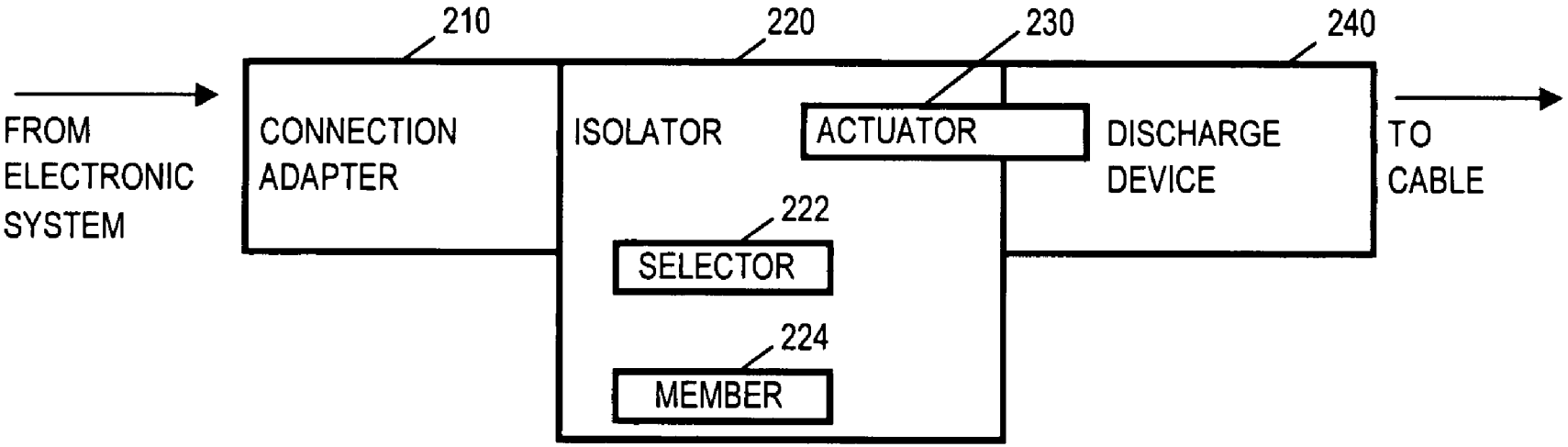
FIG. 2 depicts an embodiment of an adapter to discharge an electrostatic charge on conductors of a cable.

FIG. 2 depicts an embodiment of an adapter 200 to discharge an electrostatic charge on conductors of a cable via a conductor of a connector. Adapter 200 comprises a connection adapter 210, an isolator 220, an actuator 230, and a discharge device 240. Connection adapter 210 may be designed to connect to one or more types of connectors found on computers and other electronic devices such as serial connectors, parallel connectors, male connectors, female connectors, and the like. In some embodiments, connection adapter 210 may facilitate conversion from, e.g., a USB connector or FireWire connector to another type of serial or parallel connector. In other embodiments, connection adapter 210 may include a selector such as a sliding switch to facilitate selection of a selected conductor for discharging a cable.

Isolator 220 may isolate conductors other than the selected conductor from conductors of a cable until the conductors of the cable have substantially discharged an electrostatic charge. Isolator 220 comprises selector 222 and member 224. Selector 220 may be any type of arrangement that facilitates coupling conductors of a cable to a selected conductor in a first state via member 224 and switching to a second state in response to activation of actuator 230. The second state may electrically interconnect conductors of the cable with conductors of the electronic system in a manner that provides communication across the cable between the electronic system and another device or electronic system.

Actuator 230 may mechanically, electrically, optically, or otherwise interconnect isolator 220 with discharge device 240 to indicate when to switch from a discharge state to a communications state and/or to effect such a change. For example, coupling a cable with discharge device may complete an electrical connection, or close an open loop, which activates a switch, causing isolator 220 to change states.

Discharge device 240 may switch isolator 220 from a discharge state to a communications state. Discharge device 240 may couple with the cable to connect conductors of the cable with isolator 220. In one embodiment, discharge device 240 comprises distinct discharge elements adapted to contact the conductors of the cable prior to the conductors of the cable coupling with communication conductors of the discharge device 240. The communication conductors then interconnect the cable with circuitry of the electronic device via isolator 220 and connection adapter 210. In another embodiment, discharge device 240 may utilize the same conductors for discharging the electrostatic charge from the cable and for establishing communications with the electronic device by switching the state of isolator 220.

Figure 3:
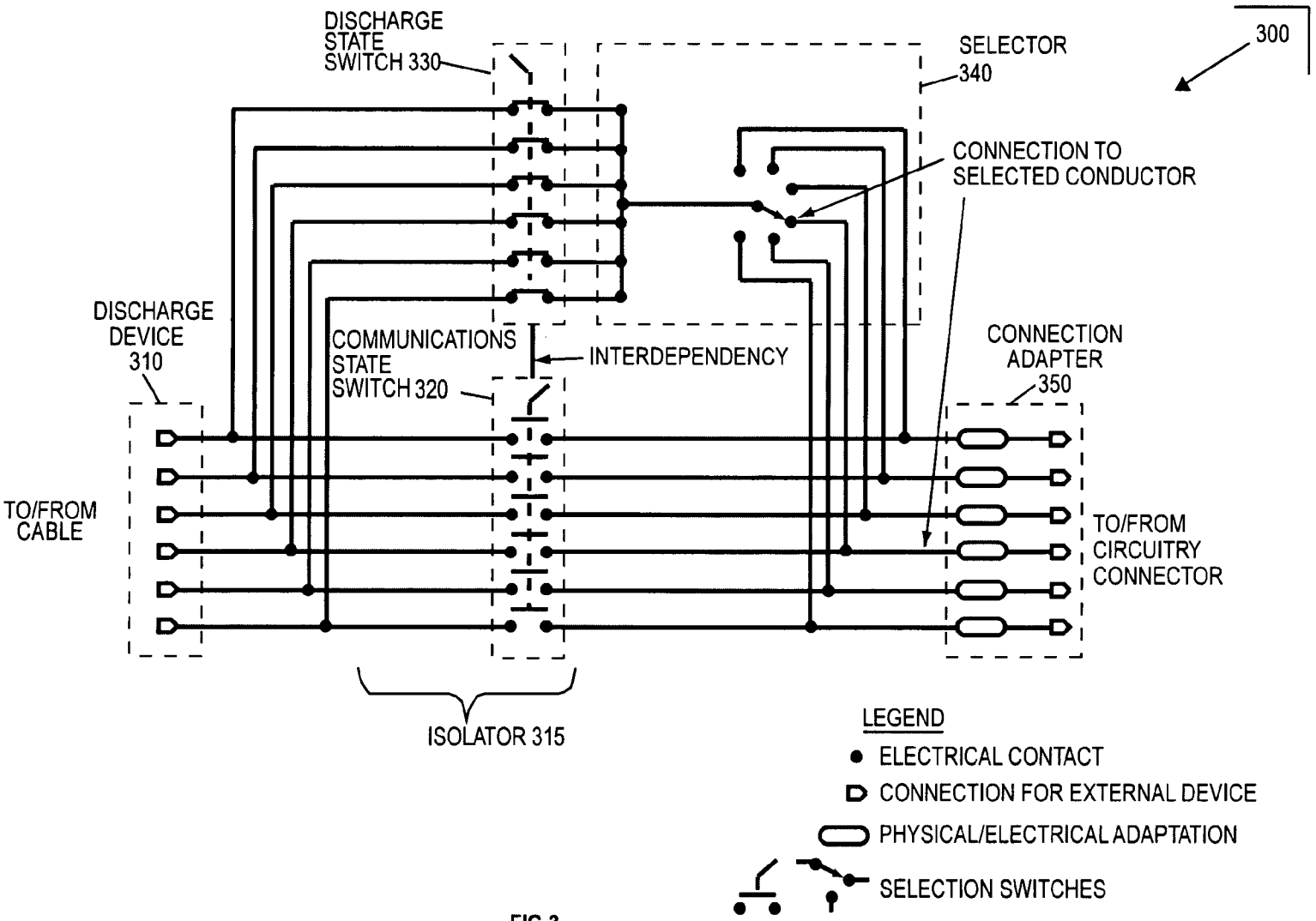
FIG. 3 depicts a circuit diagram of an embodiment of an adapter.

FIG. 3 depicts a circuit diagram 300 of an embodiment of an adapter. Circuit diagram 300 comprises a discharge device 310, an isolator 315, a selector 340, and a connection adapter 350. Discharge device 310 includes connectors to couple with conductors of a cable. The cable conductors couple with isolator 315. Isolator 315 provides two distinct electrical paths to the circuitry connector for an electronic device. The discharge path couples the cable conductors with discharge state switch 330. In the present embodiment, the discharge state switch is shown in a closed position to direct an electrostatic discharge through discharge state switch to selector 340.

The state of discharge state switch 330 has an interdependency with the state of communications state switch 320 in the present embodiment. The interdependency may force discharge state switch to be closed when communications state switch is open and vice versa. In some embodiments, the interdependencies may also require make-before-break state changes, break-before-make state changes, and the like. Further embodiments may provide switches with no interdependency.

While the symbols utilized for the switches may be indicative of a type of switch, the switches may be any type of switch that performs the indicated switching events.

Selector 340 may offer selection of a conductor through which to discharge an electrostatic charge from the cable. Selector 340 illustrates a rotary type switch but embodiments may implement any type of switch that allows selection between two or more conductors of the circuitry connector. Such a switching function may be accomplished by mechanical connection, or by solid-state switching circuitry.

Connection adapter 350 couples the conductors from the cable with the selected conductor via selector 340 while discharge state switch 330 is in a closed state and couples the conductors of the cable through to multiple conductors in the connection adapter 350 when communications state switch 320 is in a closed state. Note that the conductors of the cable reach connection adapter 350 in parallel paths via communications state switch 320 to facilitate transmission of communications between the circuitry connector and the cable.

Figure 4A:
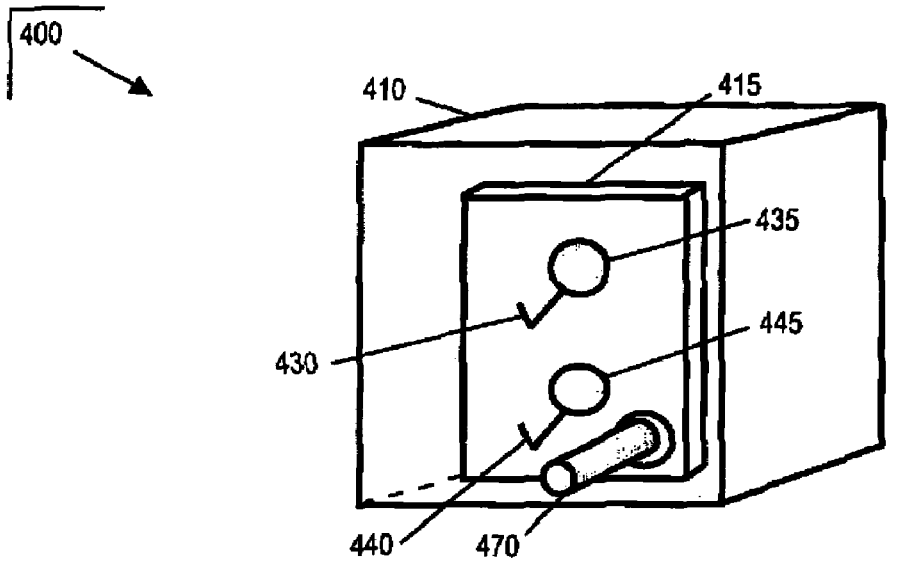
FIGS. 4A–C depict an embodiment of a female-to-male adapter.
Figure 4B:
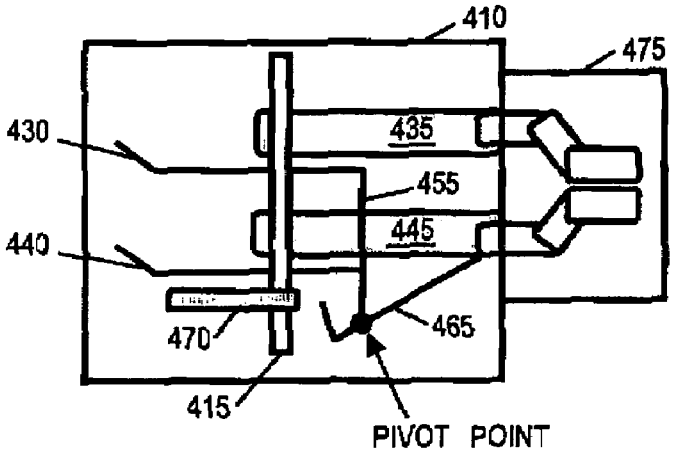
Figure 4C:
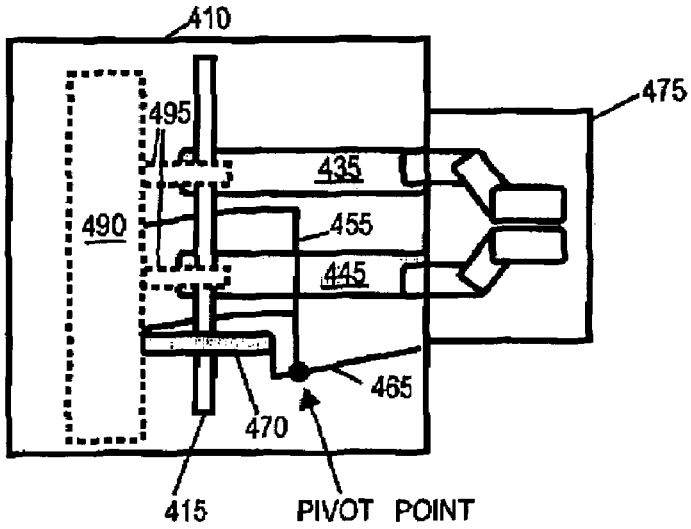

FIGS. 4A–C depict an example of a female-to-male adapter 400 adapted to attenuate an electrostatic charge on a cable. Adapter 400 comprises a housing 410, a mounting 415, discharge elements 430 and 440, conductors 435 and 445, an isolator 465, an actuator 470, and a connection adapter 475 (shown in FIGS. 4B–C). FIGS. 4A and 4B illustrate front and side views of adapter 400 respectively. FIG. 4C illustrates another side view while a cable connector 490 is being coupled with adapter 400.

Housing 410 may position mounting 415 to couple with cable connector 490. Mounting 415 couples with discharge elements 430 and 440 to hold the discharge elements 430 and 440 in position while a cable connector 490 (illustrated in FIG. 4C) is being coupled with adapter 400. Member 455 electrically interconnects discharge elements 430 and 440. Actuator 470 is adapted to contact cable connector 490 after substantially discharging male pins 495 to decouple discharge elements 430 and 440 from the selected conductor 445. More specifically, as cable connector 490 engages actuator 470, actuator 470 begins to slide toward isolator 465. As actuator 470 continues to slide in that direction, actuator 470 contacts isolator 465 and isolator 465 rotates about the pivot point to disconnect isolator 465 and the conductors of cable connector 490 from selected conductor 445.

In some embodiments a spring may couple with isolator 465 to re-couple discharge elements 430 and 440 with selected conductor 445 after cable connector 490 is disconnected from adapter 400.

Connection adapter 475 illustrates one embodiment of a connection adapter to physically alter the orientation/arrangement of conductors to adapt the conductors to interconnect with a connector on an electronic system.

Figure 5A:
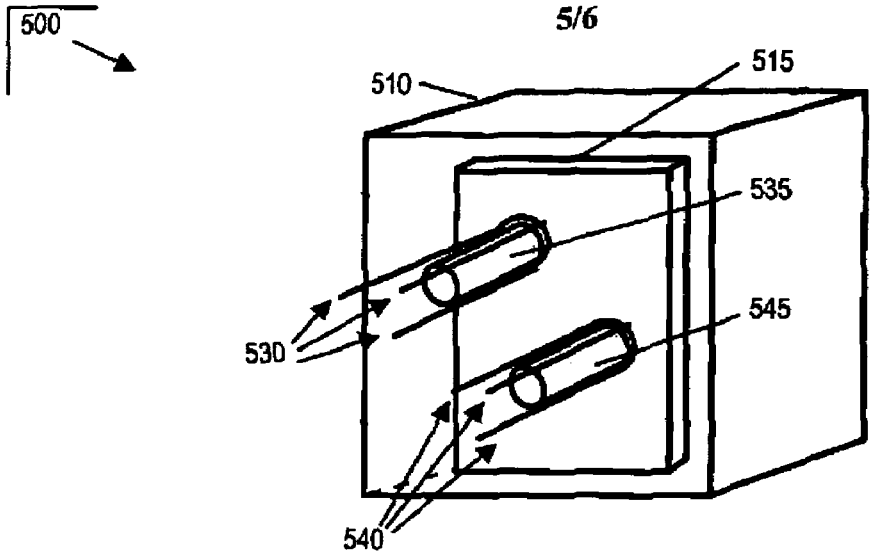
FIGS. 5A–C depict an embodiment of a male-to-male adapter.
Figure 5B:
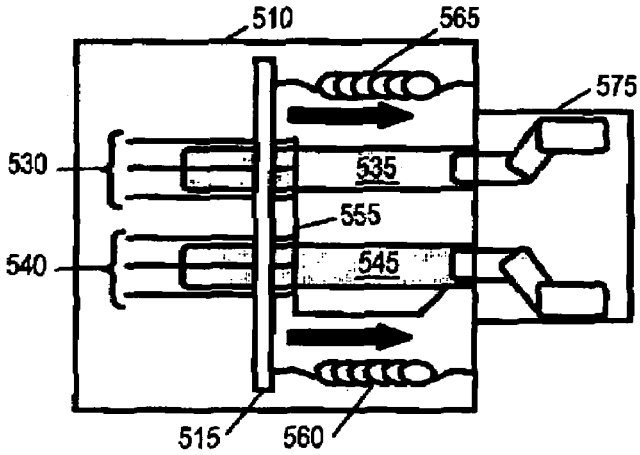
Figure 5C:
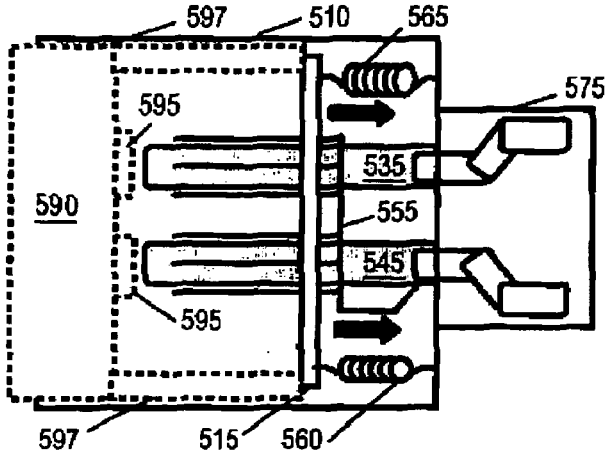

FIGS. 5A–C depict an example of a male-to-male adapter 500 adapted to attenuate an electrostatic charge on a cable. Adapter 500 comprises a housing 510, a mounting 515 coupled with springs 560 and 565 (shown in FIGS. 5B–C), discharge elements 530 and 540, conductors 535 and 545, and an isolator 555. FIGS. 5A and 5B illustrate front and side views of male connector 500 respectively. FIG. 5C illustrates another side view while a cable connector 590 is being coupled with adapter 500.

Housing 510 may define a shape within which cable connector 590 fits to prevent interconnections between incorrect conductors. Mounting 515 couples with discharge elements 530 and 540 to hold the discharge elements 530 and 540 in position while a cable connection (illustrated in FIG. 5C) is initially being established. Mounting 515 contacts members 597 of cable connector 590 after discharge elements 530 and 540 contact cable conductors 595 to move discharge elements 530 and 540 out of the way of an interconnection between cable connector 590 and conductors 535 and 545.

Springs 560 and 565 couple with mounting 515 to reposition discharge elements 530 and 540 in the insertion path of conductors 595 as cable connector 590 is disconnected from adapter 500. In further embodiments, members 597 may rotate mounting 515 to move discharge elements 530 and 540 out of the way of the connection or otherwise disconnect or isolate discharge elements 530 and 540 from conductors 595.

Connection adapter 575 illustrates one embodiment of connection adapter to physically alter the orientation/arrangement of conductors to adapt the conductors to interconnect with a connector on an electronic system.

Figure 6:
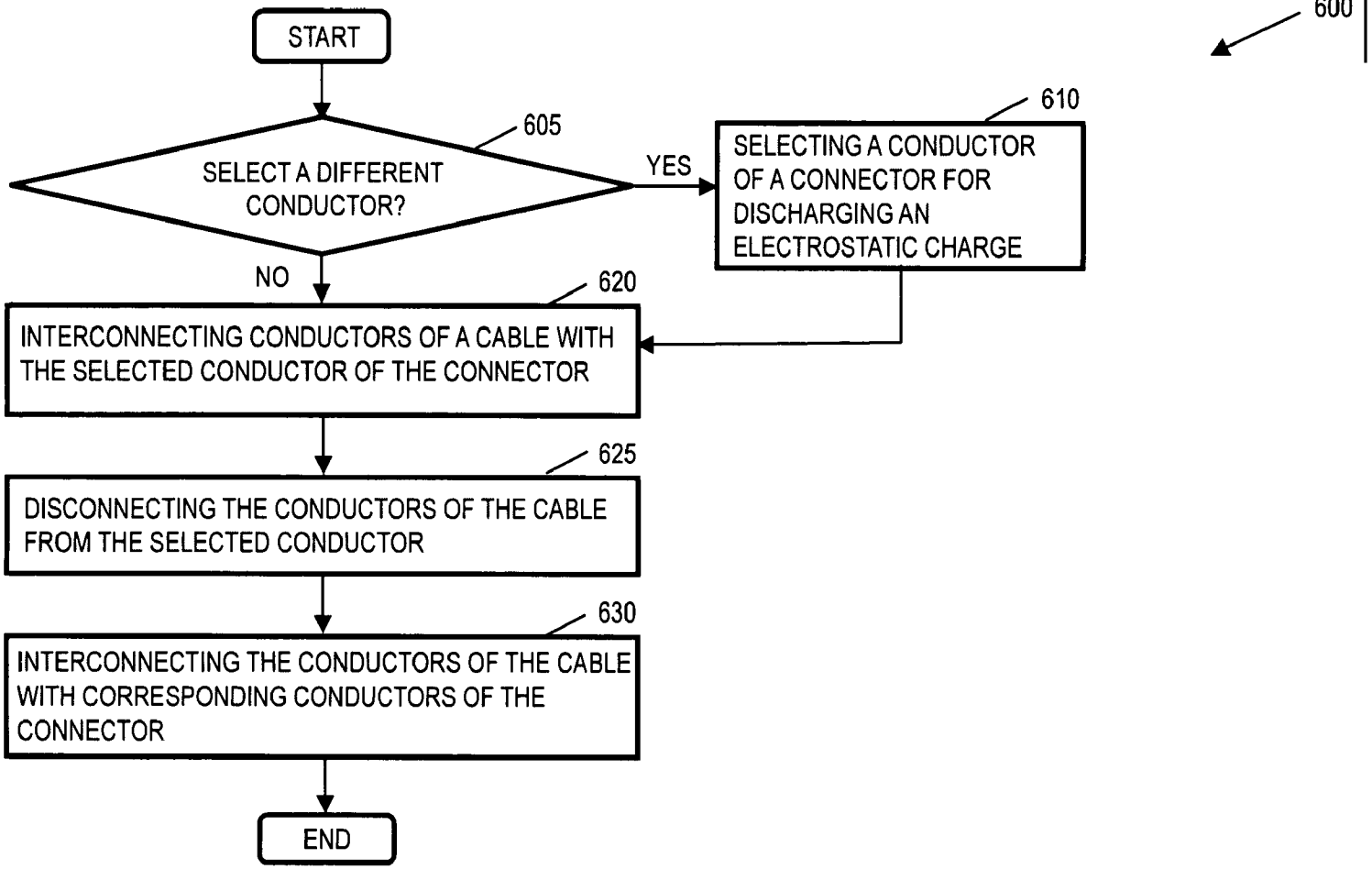
FIG. 6 depicts a flowchart of an embodiment to attenuate electrostatic discharges of a cable.

Referring now to FIG. 6, there is shown a flowchart 600 of an embodiment to adapt an electronic system to attenuate electrostatic discharges of a cable as the cable is connected with a connector on the electronic system. Flow chart 600 begins with a decision element to determine whether to select a different conductor through which to discharge an electrostatic charge (element 605). For example, the adapter may include a selector such as a sliding switch that allows an appropriate conductor to be selected depending upon the electronic device. For instance, for a particular PDA, the correct conductor of a mini-USB connector may be conductor number one.

If the conductor has not yet been selected based upon the intended use and the intended use is not the same as the default setting, the flowchart 600 continues with selecting a conductor of a connector for discharging an electrostatic charge (element 610). Selecting the conductor may entail rotating a rotary switch to a position indicative of, e.g., conductor number one. In further embodiments, selecting the conductor may entail pressing a button until the state of the switch is indicative of selection of conductor number one.

Once the conductor is selected or if the selected conductor is appropriate for the intended electronic device, flowchart 600 continues with interconnecting the conductors of the cable with the selected conductor of the connector (element 620). For instance, all the conductors of the cable may be interconnected to conduct the entire electrostatic charge through the selected conductor.

After the electrostatic charge is discharged through the selected conductor, the isolator disconnects the conductors of the cable from the selected conductor (element 625) and couples the conductors with corresponding conductors of the connector (element 630) to facilitate communications between the electronic device and another electronic device. For example, once the cable is discharged, one end of the cable is coupled with corresponding conductors of a computer and the other end of the cable is coupled with a PDA to facilitate communications such as data transfers and commands through the cable.

It will be apparent to those skilled in the art having the benefit of this disclosure that the present invention contemplates methods and arrangements to attenuate electrostatic discharges of a cable when connected with a connector on an electronic system. It is understood that the form of the invention shown and described in the detailed description and the drawings are to be taken merely as examples. It is intended that the following claims be interpreted broadly to embrace all the variations of the example embodiments disclosed.

Although the present invention and some of its advantages have been described in detail for some embodiments, it should be understood that various changes, substitutions and alterations can be made herein without departing from the spirit and scope of the invention as defined by the appended claims. Although an embodiment of the invention may achieve multiple objectives, not every embodiment falling within the scope of the attached claims will achieve every objective. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An apparatus comprising:

a connection adapter to couple with a first connector of an electronic system, the connection adapter to interconnect conductors of a cable via a second connector of the cable with conductors of the first connector;

an isolator, in a first state, to couple the conductors of the cable with a selected conductor of the first connector and, in a second state, to couple the conductors of the cable with corresponding conductors of the first connector for communication of data across the cable with the electronic system; and a discharge device coupled with the isolator to switch the isolator from the first state to the second state while coupling the cable with the electronic system.

2. The apparatus of claim 1, wherein the connection adapter comprises a selector to select the selected conductor of the first connector.

3. The apparatus of claim 1, wherein connection adapter comprises a universal serial bus (USB) adapter.

4. The apparatus of claim 1, wherein the connection adapter comprises a parallel bus adapter.

5. The apparatus of claim 1, further comprising an actuator coupled with the apparatus to interconnect the discharge device with the isolator, wherein the actuator is to be activated during connection of the cable with the apparatus to switch the isolator from the first state to the second state.

6. The apparatus of claim 1, wherein the discharge device comprises discharge elements to couple the conductors of the cable with the selected conductor of the first connector while the isolator is in the first state.

7. The apparatus of claim 6, wherein the isolator is to electrically interconnect the discharge elements while the discharge elements couple the conductors of the cable with the selected conductor of the first connector.

8. The apparatus of claim 1, wherein the isolator comprises a mounting and the discharge device comprises discharge elements coupled with the mounting and at least one spring coupled with the mounting to switch the isolator into the first state when the cable initially contacts the discharge device, wherein the mounting positions the discharge elements to contact the conductors of the cable, and to switch the isolator to the second state when the cable is fastened to the apparatus, wherein the mounting positions the discharge elements to disconnect the discharge elements from the conductors of the cable.

9. The apparatus of claim 1, wherein the discharge device comprises an actuator to switch the isolator from the first state to the second state in response to contact between the cable and the discharge device.

10. The apparatus of claim 1, wherein the discharge device comprises discharge elements to conduct a charge from conductors of the cable, wherein the discharge elements are positioned in an insertion path of the conductors of the cable to momentarily contact the conductors of the cable as the cable couples with the apparatus.

11. A system to attenuate electrostatic discharges from a cable to an electronic system, the system comprising:

an enclosure comprising a first connector, wherein the first connector interconnected with circuitry in the enclosure; and an adapter to couple with the first connector, the adapter comprising:

a connection adapter to couple with the first connector, the connection adapter to interconnect conductors of a cable via a second connector of the cable with conductors of the first connector;

an isolator to couple the conductors of the cable with a selected conductor of the first connector in a first state and to couple the conductors of the cable with corresponding conductors of the first connector in a second state for communication via the cable with the electronic system; and a discharge device coupled with the isolator to switch the isolator from the first state to the second state while coupling the cable with the electronic system.

12. The system of claim 11, further comprising an actuator coupled with the apparatus, wherein the actuator is to move in response to connection of the cable with the isolator, the movement of the actuator to switch the isolator from the first state to the second state.

13. The system of claim 11, wherein the discharge device comprises discharge elements to couple with the conductors of the cable.

14. The system of claim 13, wherein the isolator is to electrically interconnect the discharge elements while the discharge elements couple the conductors of the cable with the selected conductor of the first connector.

15. The system of claim 11, wherein the isolator is adapted to switch into the first state when the cable initially contacts the discharge device and to switch into the second state momentarily after the cable initially contacts the discharge device.

16. The system of claim 11, wherein the discharge device comprises an actuator to interconnect the discharge device and the isolator, wherein the isolator comprises a switch and the actuator is to change the state of the switch to switch the isolator from the first state to the second state in response to contact between the cable and the discharge device to disconnect at least one of the conductors of the cable from the selected conductor of the first connector.

17. The system of claim 11, wherein the discharge device comprises discharge elements to conduct a charge from the conductors of the cable, wherein the discharge elements are positioned in an insertion path of the conductors of the cable to momentarily contact the conductors of the cable as the cable couples with the electronic system via the second connector.

18. A method to attenuate electrostatic discharges of a cable, the method comprising:

connecting an adapter with a first connector of an electronic system to interconnect conductors of the first connector with conductors of the adapter;

interconnecting conductors of a cable via a second connector of the cable with a selected conductor of the first connector via an isolator of the adapter to discharge an electrostatic charge from the conductors of the cable through the selected conductor; and changing the state of the isolator to disconnect the conductors of the cable from the selected conductor and to interconnect the conductors of the cable with corresponding conductors of the first connector for communication of data via the cable with the corresponding conductors of the first connector.

19. The method of claim 18, further comprising selecting the selected conductor of the first connector via a switch.

20. The method of claim 18, wherein changing the state of the isolator comprises engaging an actuator as the second connector is coupled with the adapter, wherein activation of the actuator in response to coupling the second connector with the adapter changes the state of the isolator.

* * * * *